United States Patent [19]

Giraldi et al.

[11] Patent Number: 4,718,366

[45] Date of Patent: Jan. 12, 1988

[54] PROCESS FOR THE MANUFACTURE OF TUFTED RUGS, CARPETS, ETC. AND PRODUCTS MANUFACTURED THEREBY

[75] Inventors: Carlos D. Giraldi; Joao M. Giraldi, both of Rio de Janeiro, Brazil

[73] Assignee: Industria E Comercio Textil Avanti Ltda, Rio de Janeiro, Brazil

[21] Appl. No.: 889,711

[22] Filed: Jul. 28, 1986

[30] Foreign Application Priority Data

Jan. 31, 1986 [BR] Brazil ..... 8600411

[51] Int. Cl.[4] ..... D05C 15/00

[52] U.S. Cl. ..... 112/266.2

[58] Field of Search ..... 112/410, 266.2

[56] References Cited

U.S. PATENT DOCUMENTS 3,515,622 6/1970 Jordan ..... 112/410 X 3,964,411 6/1976 Smith ..... 112/410

*Primary Examiner*—Ronald Feldbaum

*Attorney, Agent, or Firm*—Beveridge, DeGrandi and Weilacher

[57] ABSTRACT

The present invention relates to a process for the manufacture of tufted rugs and carpets, or similar products, characterized by the fact that a first application of yarns is inserted by a bank of needles over a prewoven base then over which a second application of yarns is made in a different direction from the first, forming a two directional tufted structure; the process can produce tufted carpets in any size and shape without joints, and results in self-supporting yarns. It also manufactures other tufted textile products through the two and the three-directional tufting process.

7 Claims, 2 Drawing Figures

Figure 1:
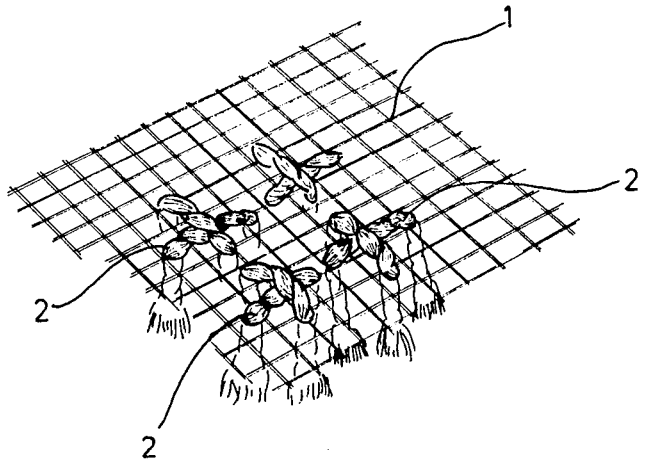

PROCESS FOR THE MANUFACTURE OF TUFTED RUGS, CARPETS, ETC. AND PRODUCTS MANUFACTURED THEREBY

The present invention refers to a process for the manufacture of tufted rugs, carpets and similar products to be used mainly as floor coverings.

Such products have their origin in man's manual dexterity and have, therefore, been known since the remotest times. The most ancient machines used manual labor. Over the ages constant and gradual development has led to the machines and processes presently known and employed for the manufacture of rugs. Such products are made of felt, tapestry, shuttle-woven material, or of nappy fabric of natural or synthetic fibers.

The methods well-known at present for the industrial manufacture of rugs, carpets and similar products can be classified along with those used for the manufacture of velvet, Wilton, Axminster, Chenille, tufted and knitted carpets.

Velvet: The velvet loom laces strips of threads abraded on their upper surface in order to form the pile of the carpet. The strips are inserted through the loom in groups of fifteen or more, with slipknots being formed on one, two or three strips. When each row of knotted pile is completed, the wire strips at the front part is removed or partly withdrawn, and reinserted in the back part of the next row of slipknots. If the wire has a sharpened edge that can cut the knot in the pile, it will form a tuft or a cut pile velvet. If the wire is smooth and the knot is not cut, there will be formed an uncut tuft, or knotted and tufted velvet. Most carpet known as laced carpet is created by using this method. Usually, two or three loom cylinders of warped threads are used. One cylinder feeds the basic warp yarn that binds the carpet together; another loom cylinder supplies the pile thread and the third loom cylinder may be used for the padding thread.

The velvet loom is mostly used for carpets of strong colors, but it can be used to weave carpets of any color. One method consists of forming the pile thread by twisting one or more threads of different colors. These are known as "moresque" threads and they produce the effect of a blending of colors. Another method uses two sets of lengthened threads instead of one. This supplies an additional division through which a thread of a second color may be woven.

Wilton: The Wilton loom works on the same basic principle as the velvet loom but it has greater versatility owing to its use of the Jacquard mechanism. More than six different colors can be used and the presence of each on the surface of the carpet can be controlled to create the desired design. When a given color is not to appear on the surface, the threads of that color are laced into the base of the carpet. In addition to varying the color patterns, the Jacquard mechanism can regulate the thickness of the texture. The height of the pile can be adjusted to form knots and other patterns, allowing for cut and uncut surfaces. The Jacquard mechanism is controlled by means of perforated ropes or paper ribbons that determine which threads are to be moved in position to the wires hung in loops. Another form of the Wilton weave is the double-face Wilton in which two fabrics are woven simultaneously, with the pile thread passed behind and in front of the fabric. A knife, moving the pile up to and through the front part of the loom, cuts the pile threads between the two fabrics, producing two separate carpets.

Axminster: Axminster carpets can be woven on three different looms; the Axminster loom with shuttle; the Axminster loom with pincers; or—a combination of the first two—the Axminster loom with shuttle-pincers. The Axminster loom with shuttle, unlike the velvet and Wilton looms, forms its pile threads by means of small shuttles. The Axminster is the only weaving method that can produce a different coloration for each individual tuft in a repeated pattern, and it can create designs of any complexity. However, since this method does not lend itself to the production of a series of carpets with the same design, the preparation of the pre-weave for complex designs is tiresome and time-consuming.

Chenille: Chenille carpets are produced with two looms. The surface of the thread is woven into the interior of a cover or blanket in one loom and then it is cut into long strips of lining. The second loom weaves the back of the carpet and at the same time forms an opening or shed through which the pre-woven strips are inserted, brushed into place and secured.

Tufted carpets: The tufting process differs from other basic methods of carpet production both because it uses a needle instead of a weave action to form the pile of the carpet and because it uses a pre-woven base for the basic construction. When the base moves through the tuft application machine, a bank of needles as wide as the carpet inserts individual tufts of pile yarn into the base. The needle mechanism inserts the tufts into the base, and later latex is applied to the surface of the base in order to hold the tufts in place. The yarn can be supplied to the needles through tubes that lead out from cones containing sets of yarns, arranged in a large shelf (cage) or basket located behind the machine. Each needle is fed by an individual cone, which is connected to a "magazine" or "feeder" roll. Subsequently, electronic and mechanical controls were developed that make it possible to produce carpets of different fiber lengths and textur designs.

In this process, since the bank of needles is of a fixed and predetermined width, and since, therefore, the carpets are produced with that width, there is the great disadvantage that when it is necessary to cover large or irregularly shaped areas, which is what normally happens in practice, several sections of the carpet must be recut and/or joined in order to make a single carpet with the desired dimension. Many large scraps are left over, which increases the price of the finished carpet. Further, since a perfect alignment of the various joined sections is impossible (even if the patterns are identical), such a process of carpet manufacture is limited to single-color carpets or, at most, to carpets with parallel stripes. It is impossible with this process to produce reticulated, square, checked or other similar patterns.

Methods such as those mentioned above the production of rugs, carpets and other similar products are still deficient in the way they arrange the rows of pile in the base. The traditional arrangement consists of parallel rows of contiguous pile yarns that support themselves against the contiguous yarns of the same row, but not against those of the row on either side, thereby configurating portions or interruptions of surface density or continuity of the pile yarns, which in its turn accelerates the speed at which the carpet compacts and ages, processes especially provoked by threading, the rolling of casters, the impression of furniture, and other such things. Besides this, the traditional tufted carpets, especially those made of joined sections, vary in shade when viewed from different locations.

Consequently, the object of the present invention is to provide an original process for producing tufted carpets and rugs, which eliminates the disadvantages of products tufted by the traditional systems of tufted carpets. The new process makes possible the production of an infinite variety of patterns, including horizontal, vertical, or diagonal stripe patterns, which up to now have not been possible without varying the width of the loom.

This object is achieved through a tufting process in which a first application of tuft forming yarns is effected by a bank of needles on a pre-woven base to form a first set of parallel rows of tufts; and then a second application of tuft forming yarns is made to form a second set of parallel rows of tufts in a different direction from said first set of parallel rows of tufts, to form a two-directional tufted structure.

A second embodiment of the invention is a process in which a third application of tuft forming yarns is made in a different direction from those of said first and second sets of parallel rows of tufts to form a three-directional tufted structure.

An additional embodiment of the invention is that the rows of yarns forming the said two directional tufting are perpendicular to each other and the direction of the set of rows of tufts which complete the said three-directional tufted structure is diagonal in relation thereto. Preferably the loops of the tufts overlap each other at a single point.

The process proposed by the invention results in a tufted textile with a completely new construction; it does not present the disadvantages of the similar, more traditional products, since the pile yarns are self-supporting, the finished product is highly resistant to compaction, setting a new standard of quality for tufted rugs or carpets.

The tufted textile product, resulting from the process of a two directional tufting on a pre-woven base, excels because it presents a structure where the first set of rows formed by slip-knot of yarns applied over a pre-woven base and cut in the form of a U, whose central parts are placed on one side of the base, while their legs cross the base and extend out from the other side; the said yarns in the form of a U are placed on a single plane, in order that the second set of rows of similar yarns will have their central parts overlapping the central parts of the yarns of the first set of rows, but in a different direction from those of the first rows.

In another variation of the invention, the tufted textile product results from a three-directional tufting process, in which a three-directional tufting is made over a two-directional tufting, presenting a structure with a third set of parallel rows of yarns, having their central parts overlapping the central parts of the yarns of the second set of rows, but in a different direction from both the first and second rows.

Figure 2:
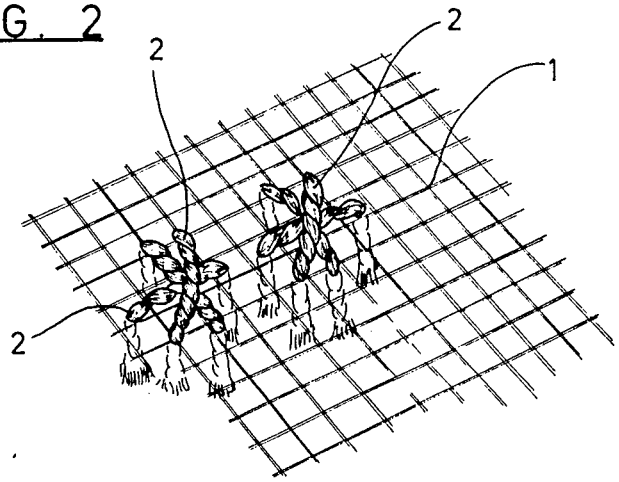

The process will be explained in more detail by reference to two examples of the limitless possibilities of the invention, illustrated by the attached drawings, where FIG. 1 is an illustration of the principle behind the invention's two-directional tufting process; and FIG. 2 is an illustration of the principle behind the invention's three directional tufting process.

FIG. 1 represents aspects of the two directional tufting. This tufting is made over a pre-woven base 1. The pre-woven base 1 is placed in a tuft application machine (not shown in the drawings) which presents a bank of needles that inserts the yarns 2 into base 1, in order to form rows of a first set of parallel tufts running the length of the carpet. After finishing the tufting in the first direction, the process is repeated in another direction over the base 1, forming a two-directional tufting. In said two-directional tufting the directions between the first set of parallel tufts and the second set of parallel tufts are different. The structure of the tufting thus created yields a structure of yarns 2 that excels, not only for rows of parallel yarns 2, but also for rows of yarns 2 inserted in an arrangement where there is a central yarn in each square or rectangular cell with four more yarns applied at each vertex. This yields a denser texture, in which, as mentioned above, the yarn are self-supporting.

The three-directional tufting process, which can also be extended to more than three directional tufting, as can be seen in FIG. 2, consists of repeated applications of yarns 2 over a product of the two-directional process. Thus, another application of yarns, is made over the two-directional tufting, but in a different direction than that of the two-directional tufting. The tufted structure of the product is thus extremely dense. The self-supporting effect is even greater than in the two-directional tufted product.

It will be evident that the backing fabric must have a size and/or shape which permits it to move throught the machine in both directions of two-directional tufting, and in all three directions of three-directional tufting.

Latex is applied to the back of the carpet in order to hold the pile 2 firm. Other finishing material can eventually be applied over the latex layer, the product being then finished.

This process of two-, three- or multiple directional tufting of the invention allows infinite combinations, because the yarn or piles 2 can be tufted in any direction, stripes can intersect in various directions, allowing for the formation of single- or multi-colored decorative patterns.

It should be understood that the invention is applicable to all kinds of tufting materials, producing a great variety of colors and patterns. Furthermore, the process allows for innumerable modifications in the forms of operation here described, so long as such modifications do not depart from the invention's basic features.

We claim:

1. A process for manufacturing tufted products such as rugs, carpets and the like on a pre-woven base, comprising the steps of applying a first set of tuft forming yarns to the base to form a first set of parallel rows of tufts, and then applying a second set of tuft forming yarns to the base to form a second set of parallel rows of tufts which lie in a different direction from said first set of parallel rows of tufts, to form a two-directional tufted structure.

2. A process according to claim 1, wherein the tufts are applied in directions which cause the first set of rows of tufts to lie perpendicular to said second set of rows of tufts.

3. A process according to claim 1, including the step of applying a third set of tuft forming yarns to the base in a different direction from those of said first and second sets of parallel rows of tufts to form a three-directional tufted structure.

4. A process according to claim 3 wherein the rows of tufts in the first and second sets are formed perpendicularly to each other, and the row of tufts in the third set is formed to lie diagonally with respect to the rows of tufts in the first and second sets.

5. A process according to claim 1, wherein the loops of the tufts are formed in overlapping relationship with respect to each other at a single point.

6. A tufted product manufactured according to the process defined in claim 1.

7. A tufted product manufactured according to the process defined in claim 3.

* * * * *